United States Patent [19]

Oesterle

[11] 4,015,640

[45] Apr. 5, 1977

[54] HIGH SPEED BROAD FABRIC LOOM REED CONSTRUCTION

[75] Inventor: Gerhard Oesterle, Staad, SG, Switzerland

[73] Assignee: Aktiengesellschaft Adolph Saurer, Switzerland

[22] Filed: Mar. 4, 1976

[21] Appl. No.: 663,918

Related U.S. Application Data

[63] Continuation-in-part of Ser. No. 521,759, Nov. 7, 1974, abandoned.

[30] Foreign Application Priority Data

Nov. 28, 1973 Switzerland ..... 01672/73

[52] U.S. Cl. ..... 139/192

[51] Int. Cl.[2] ..... D03D 49/62

[58] Field of Search ..... 139/192, 188 R, 190, 139/193, 1 R, 48, 91; 28/54

[56] References Cited

UNITED STATES PATENTS

| | | | |
|---|---|---|---|
| 2,162,312 | 6/1939 | Kronoff | 139/188 R |
| 2,439,688 | 4/1948 | Gordon | 139/188 R |

FOREIGN PATENTS OR APPLICATIONS

| | | | |
|---|---|---|---|
| 6,911,347 | 1/1971 | Netherlands | 139/91 |
| 355,481 | 8/1931 | United Kingdom | 139/192 |

*Primary Examiner*—James Kee Chi

*Attorney, Agent, or Firm*—McGlew and Tuttle

[57] ABSTRACT

A reed for high speed broad fabric loom comprises an upper reed beam, a lower reed beam and blades stretched between the upper and the lower reed beams. A dynamic oscillation absorber in the form of a mass is mounted on either the upper or the lower beam or both by means of a resilient mounting in order to provide a stamping action transverse to the plane of the reed blades. A particularly favorable effect on the loom sley oscillations and the flight of the shuttle on the sley path is effected if the dynamic vibration absorber is mounted on the bottom rib or the lower sley beam rather than on the top beam.

6 Claims, 3 Drawing Figures

HIGH SPEED BROAD FABRIC LOOM REED CONSTRUCTION

CROSS REFERENCE TO RELATED APPLICATION

This application is a continuation-in-part of copending U.S. patent application Ser. No. 521,759 filed Nov. 7, 1974 now abandoned.

BACKGROUND OF THE INVENTION

1. Field of the Invention

This invention relates in general to the construction of reeds for high speed broad fabric looms and in particular to a new and useful reed which includes upper and lower reed beams having blades stretched therebetween and which is provided with a damping member extending so that it absorbs oscillations transverse to the plane of the reed blades.

2. Description of the Prior Art

In high speed broad fabric looms, particularly at high speeds, the upper and lower beams of the reed are incited to resonant oscillations during the reciprocating movement in the reciprocating direction or battening direction. This resonant oscillation is produced by various effects such as by the impact of the fabric against the reed blades at the battening of the weft or by the irregularities in the reed drive which usually acts on the lateral arms of the reed. In the middle of the reed the amplitude of such resonant oscillations is particularly large. Under the effect of such oscillation, the shuttle races along the reed beams and particularly the lower beam transverse to the direction of the vibration and it may be deviated from its race and thrown against the reed blades thereby dist urbing the picking. The resonant oscillations may even cause the shuttle to be thrown out of the shed and the weaving operation is therefore disfavorably affected.

SUMMARY OF THE INVENTION

In accordance with the invention the reed so constructed with a dynamic oscillation absorber which comprises at least one damping member resiliently mounted on at least one of the reed beams and preferably the lower reed beam. Thus the invention does not follow the obvious way of stiffening the reed beams without increasing the weight in order to increase the natural oscillation frequency of the reed. The reason for this is that this would lead to the use of expensive and spacious shapes. In this invention a dynamic oscillation absorber is mounted by a resilient mounting preferably in the center of the lower beam to provide a dynamic vibration absorber having a favorable affect on the loom sley oscillations and the flight of the shuttle on the sley path.

Accordingly it is an object of the invention to provide an improved reed for high speed broad fabric loom which comprises an upper and lower reed beam with reed blades stretched therebetween and which further includes a dynamic oscillation member mounted on at least one of the upper and lower beams so that its main direction of action is transverse to the plane of the reed blades.

A further object of the invention is to provide a dynamic oscillation absorber on a lower reed beam of a sley and which includes a support member connected to the reed beam and a weighted mass resiliently mounted on the support member particularly for resilient movement in respect to the longitudinal axis of the beam.

A further object of the invention is to provide a reed which is simple in design, rugged in construction and economical to manufacture.

For an understanding of the principals of the invention, reference is made to the following description of typical embodiments thereof as illustrated in the accompanying drawings.

GENERAL DESCRIPTION OF THE PREFERRED EMBODIMENTS

Figure 2:
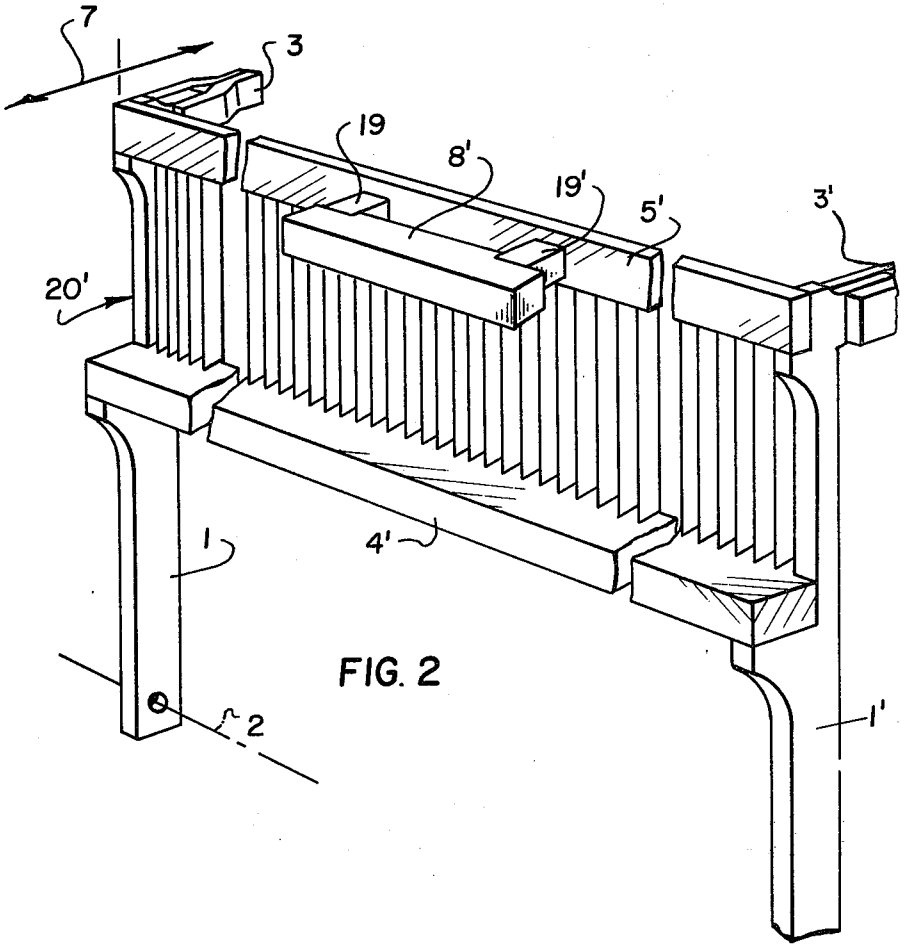
FIG. 2 is a view similar to FIG. 1 of another embodiment of the invention.

Referring to the drawings in particular the invention embodied therein comprises a sley generally designated 20 which as shown in the embodiment of the sley 20' as shown in FIG. 2 includes legs 1, 1' each of which is pivotally mounted on a loom frame (not shown) for swinging about an axis 2. Guide arms 3 and 3' are pivoted to the upper free ends of the legs 1 and 1' and are driven by a drive mechanism (not shown) to cause a reciprocation of a sley in the swinging motion indicated by the directions of the double arrows 7, in respect to the loom embodiment 20' of FIG. 2 but which is identical with the loom 20 of FIG. 1. The sley 20 includes a lower reed beam 4 which also constitutes the shuttle race and an upper reed beam 5 and reed blades 6 which are stretched between the upper and lower reed beams.

Figure 1:
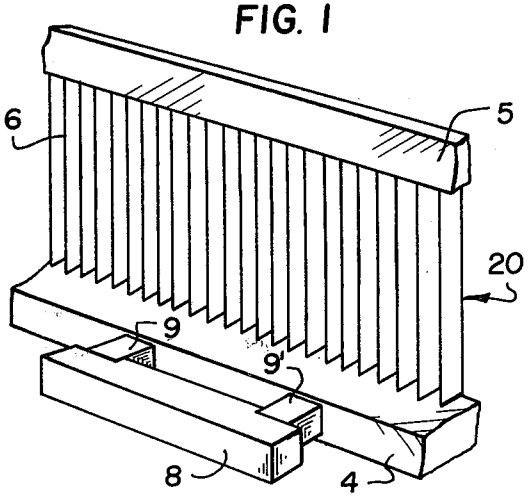
FIG. 1 is a partial front perspective view of a loom sley constructed in accordance with the invention.

In accordance with the invention preferably the lower reed beam 4 is provided with a mass 8 of a suitable heavy material such as metal or wood which is mounted thereon by means of rubber springs or resilient elements 9 and 9' which are arranged adjacent the respective ends of the mass 8. In the embodiment of FIG. 1 the resilient elements 9 are more elastic in the swinging direction shown by the double arrows 7 and they work with an inner damping.

The FIG. 2 embodiment is substantially indentical to that of FIG. 1 with the exception that a mass 8' is mounted on an upper beam 5' on resilient elements 19 and 19'. In this construction it would also be preferably to have a mass on the lower beam 4' but some damping effect would be effected with only the single mass 8' as indicated.

Figure 3:
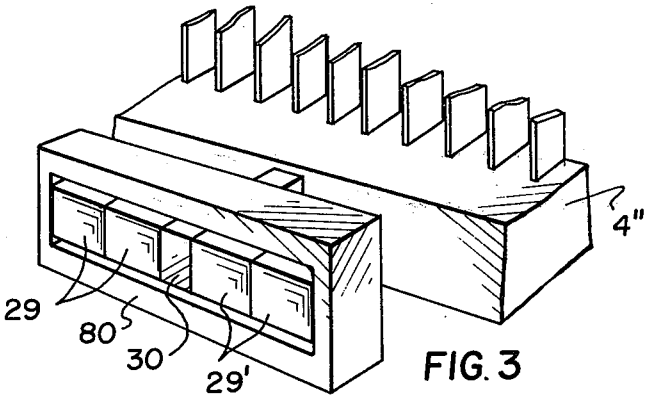
FIG. 3 is a partial perspective view similar to FIG. 1 of still another embodiment of the invention.

In FIG. 3 a mass 80 in the form of a closed frame is supported on individual resilient blocks 29 and 29' which are arranged on respective ends of a central fastening member 30. The member 30 is secured directly to either a lower beam 4'' or an upper beam or both.

In the preferred arrangement the mounting on the lower beam 4 or 4'' of the mass 8 or 80 is preferable. In addition the mounting of the mass in a central location for example on a single securing member 30 as shown in FIG. 3 has proved satisfactory and sufficient.

While specific embodiments of the invention have been shown and described in detail to illustrate the application of the principles of the invention, it will be understood that the invention may be embodied otherwise without departing from such principles.

What is claimed is:

1. A reed for high speed broad fabric loom, comprising an upper reed beam, a lower reed beam, reed blades stretched between said upper reed beam and said lower reed beam, and a dynamic oscillation absorber member comprising a mass, and mounting means including, a dampening member resiliently mounting said absorber member on at least one of said upper and lower reed beams.

2. A reed according to claim 1, wherein said mass is resiliently mounted on the lower one of said reed beams and comprises a central member secured to said lower beam, and a annular frame member surrounding said central member and resilient support members between said annular frame member and said central member.

3. A reed according to claim 2, wherein said central member is secured centrally to said reed beam and extends outwardly therefrom, said resilient members being elongated in a direction parallel to the axis of said reed beam.

4. A reed according to claim 1, wherein said mass is mounted on both the upper and lower beams.

5. A reed according to claim 1, wherein said mass includes a heavy endless frame member, a central securing member secured to said lower reed beam, and a plurality of resilient block members located between said central member and each respective side of said mass frame.

6. A reed according to claim 1, wherein said dynamic oscillation absorber member comprises a bar extending substantially parallel to said lower reed beam and a spring located between each end of said bar and said lower reed beam.

* * * * *